United States Patent [19]

Bible et al.

[11] Patent Number: 4,876,886

[45] Date of Patent: Oct. 31, 1989

[54] METHOD FOR DETECTING DRILLING EVENTS FROM MEASUREMENT WHILE DRILLING SENSORS

[75] Inventors: Matthew Bible, Houston; Marc Lesage, Missouri City; Ian Falconer, The Meadows, all of Tex.

[73] Assignee: Anadrill, Inc., Sugar Land, Tex.

[21] Appl. No.: 176,826

[22] Filed: Apr. 4, 1988

[51] Int. Cl.[4] ..... E21B 44/00

[52] U.S. Cl. ..... 73/151.5; 175/39

[58] Field of Search ..... 73/151, 151.5; 175/39

[56] References Cited

U.S. PATENT DOCUMENTS

| | | | |
|---|---|---|---|
| Re. 21,297 | 12/1939 | Mizell | 255/1 |
| 2,372,576 | 3/1945 | Hayward | 73/152 |
| 2,669,871 | 2/1954 | Lubinski | 73/151 |
| 3,368,400 | 2/1968 | Jorden et al. | 73/151.5 |
| 3,541,852 | 11/1970 | Brown et al. | 73/151 |
| 3,581,564 | 6/1971 | Young | 73/151 |
| 3,774,445 | 11/1973 | Rundell et al. | 73/151 |
| 3,782,190 | 1/1974 | Pittman | 73/151 |
| 3,898,880 | 8/1975 | Kelseaux et al. | 73/151 |
| 3,916,684 | 11/1975 | Rundell | 73/151 |
| 4,064,749 | 12/1977 | Pittman et al. | 73/151 |
| 4,359,898 | 11/1982 | Tanguy et al. | 73/151 |
| 4,627,276 | 12/1986 | Burgess et al. | 73/151 |
| 4,655,300 | 4/1987 | Davis, Jr. et al. | 175/39 |
| 4,685,329 | 8/1987 | Burgess | 73/151 |

*Primary Examiner*—Stewart J. Levy
*Assistant Examiner*—Kevin D. O'Shea
*Attorney, Agent, or Firm*—Stephen L. Borst

[57] ABSTRACT

Downhole Torque and Rate of Penetration are utilized to develop indications of formations having high porosity or of the development of an undergauge bit. Downhole torque is normalized by dividing it by the product of downhole weight on bit and bit size to produce Dimensionless Torque while Rate of Penetration is normalized by dividing it by the product of downhole weight on bit and rotary speed. The values of Dimensionless Torque and Normalized Rate of Penetration are compared to "normally" expected values of these quantities. Deviations from the normal values are taken as an indication of the occurrence of bit penetration of a highly porous formation or of the development of an undergauge or damaged bit.

8 Claims, 2 Drawing Sheets

METHOD FOR DETECTING DRILLING EVENTS FROM MEASUREMENT WHILE DRILLING SENSORS

BACKGROUND AND DESCRIPTION OF THE PRIOR ART

It is well known that oil field borehole evaluation may be performed by wireline conveyed instruments following the completion of the process of drilling a borehole Such techniques have been available to the oil field industry for decades Unfortunately, wireline investigation techniques are frequently disadvantageous due to their nature which requires that they be performed after drilling and after the pipe has been removed from the borehole Due to their inability to make their investigations in real time, they are unable to assist in the selection of casing, coring and testing points without significant delay. Additionally, while the wireline techniques are effective in determining formation parameters, they are unable to provide insight into the borehole drilling process itself.

In response to the shortcomings of wireline investigations, techniques which perform measurements while the borehole is being drilled are receiving greater acceptance by the oil field industry as standard, and indeed on occasion, indispensable services Many such techniques differ from the traditional wireline techniques in that the MWD techniques are able to measure drilling parameters which not only provide information on the drilling process itself but also on the properties of the geological formations being drilled. Due to the relatively recent increased use of many MWD techniques, the oil field industry is still in the process of learning from experience how to most effectively utilize the new information that is becoming available from MWD. Perhaps not surprisingly, accumulating experience is revealing some rather unexpected results that may significantly improve the knowledge and efficiency of the process of forming boreholes in the earth.

One recent example is described in U.S. Pat. No. 4,627,276 by Burgess and Lesso which is directed to a technique for remotely determining bit wear and for gaining insight into the efficiency of the drilling process from real time, in situ measurements of downhole weight on bit and downhole torque. Experience with this technique has shown that it is most effective in the drilling of boreholes in deltaic sedimentary geologies having shale beds occasionally interrupted by sandstone formations with milled-tooth bits Such a geology is found in the Gulf Coast region of the United States. Unfortunately, not all regions of the world have geologies as straight forward and as simple as the Gulf Coast Take for example the highly complex geology of California in which the pacific plate is thrusting itself under the continental plate to produce complex, highly fractured formations. In these difficult geologies, it has been discovered that the techniques of the aforementioned patent are difficult if not impossible to apply. Another geological example in which one would not expect the techniques of U.S. Pat. No. 4,627,276 to be effective is a volcanic geology. Thus, there is a need to discover and to develop methods of interpreting the measurements made while drilling complex geological formations that will bring some insight into the nature of the formations being drilled and the drilling process itself.

Such a clarifying technique has been discovered that reveals valuable and important information in the complex geologies of California and, by extension, probably in the simpler sedimentary formations as well. Contrary to expectation, it has been discovered that the drilling parameters of Rate of Penetration (ROP) and Downhole Torque (TOR) can be combined in a manner that not only may assist in identifying highly porous formations (highly fractured cherts in the California geology) but also may provide information on the undesirable drilling condition in which an undergauge or damaged bit is developed. The former is of major significance since in hard formations (such as chert) hydrocarbons tend to accumulate in fractures and the more highly fractured the formation, the greater the producibility of the stored hydrocarbons. The latter is also of major significance since the development of an undergauge bit means the diameter of the bit is slowly being reduced by abrasion of the formation on the bit to produce a slightly conical borehole which reduces in diameter with depth. As is well known, a conical borehole is a situation to be avoided, if at all possible, since it seriously magnifies the difficulty of performing subsequent operations in that section of borehole, such as continuing the drilling process with a full gauge bit or setting casing. When a conical borehole has been developed, expensive remedial actions to remove the tapering tendency of the borehole must be undertaken, such as reaming the borehole, before further activities can be resumed.

SUMMARY OF THE INVENTION

In the practice of the preferred embodiment of the present invention, a parameter designated "dimensionless torque" is combined with a parameter designated "normalized rate of penetration" to yield the above described information. Dimensionless torque is determined by dividing a downhole measurement of torque by the product of downhole weight on bit and nominal bit size Normalized rate of penetration is determined by dividing the surface acquired rate of penetration by the product of downhole weight on bit and surface acquired rotary speed. The concurrent values of dimensionless torque and normalized weight on bit are compared to normally expected values of those parameters It has been discovered that if the values of both normalized rate of penetration and dimensionless torque are high compared to normally expected values, then a highly porous or fractured formation has been encountered by the drill bit. In this manner, the driller has an early indication of having encountered a possibly productive zone in the formation. It has also been discovered that if the value of rate of penetration is within the normal range while the value of dimensionless torque is abnormally high, then it is likely that the drill bit is being worn away to an undesirable undergauge condition and should be pulled and replaced with a full gauge bit. It is believed, in this situation, that the high torque is caused by the near-bit stabilizer abrading into the borehole walls.

DESCRIPTION OF THE PREFERRED EMBODIMENT

Figure 1:
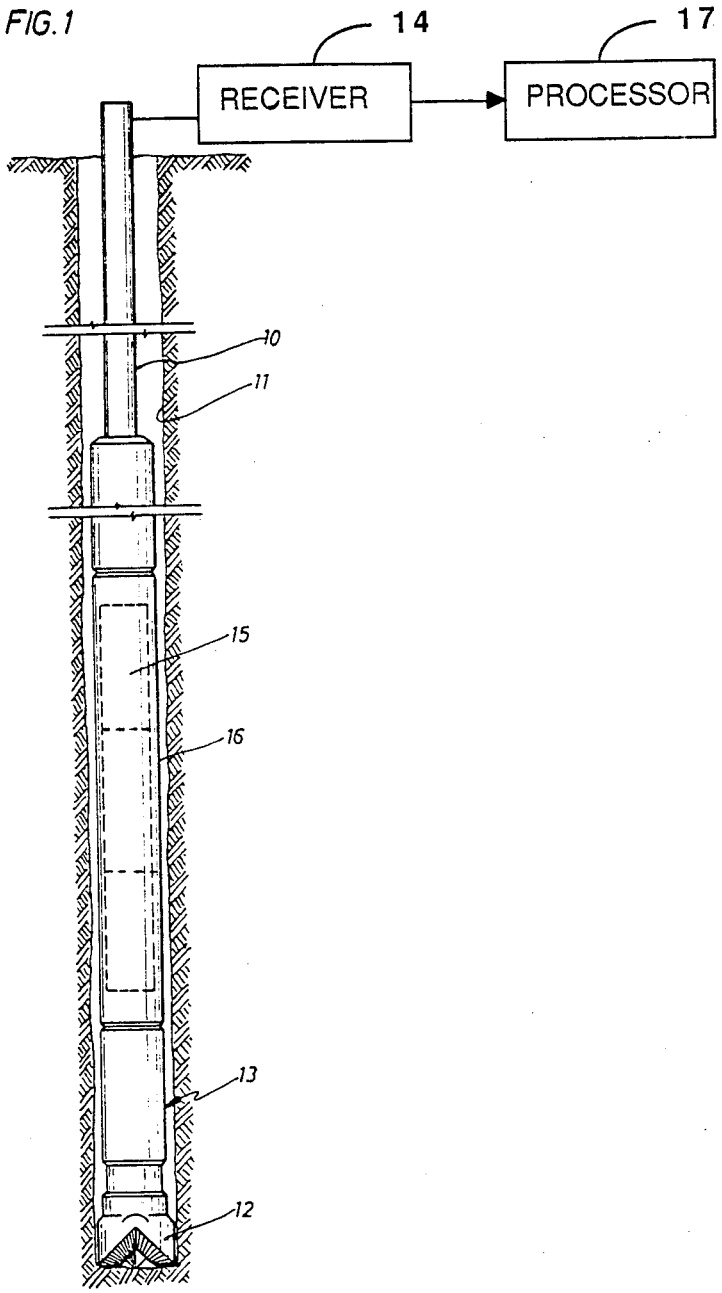
FIG. 1 is an illustration of an MWD apparatus in a drill string having a drill bit while drilling a borehole

Referring initially to FIG. 1, there is shown a drill string 10 suspended in a borehole 11 and having a typical drill bit 12 attached to its lower end. Immediately above the bit 12 is a sensor apparatus 13 for detection of downhole weight on bit (WOB) and downhole torque (TOR) constructed in accordance with the invention described in U.S. Pat. No. 4,359,898 to Tanguy et al., which is incorporated herein by reference. The output of sensor 13 is fed to a transmitter assembly 15, for example, of the type shown and described in U.S. Pat. No. 3,309,656, Godbey, which is also incorporated herein by reference. The transmitter 15 is located and attached within a special drill collar section 16 and functions to provide in the drilling fluid being circulated downwardly within the drill string 10, an acoustic signal that is modulated in accordance with sensed data. The signal is detected at the surface by a receiving system 17 and processed by a processing means 14 to provide recordable data representative of the downhole measurements Although an acoustic data transmission system is mentioned herein, other types of telemetry systems, of course, may be employed, provided they are capable of transmitting an intelligible signal from downhole to the surface during the drilling operation.

Figure 2:
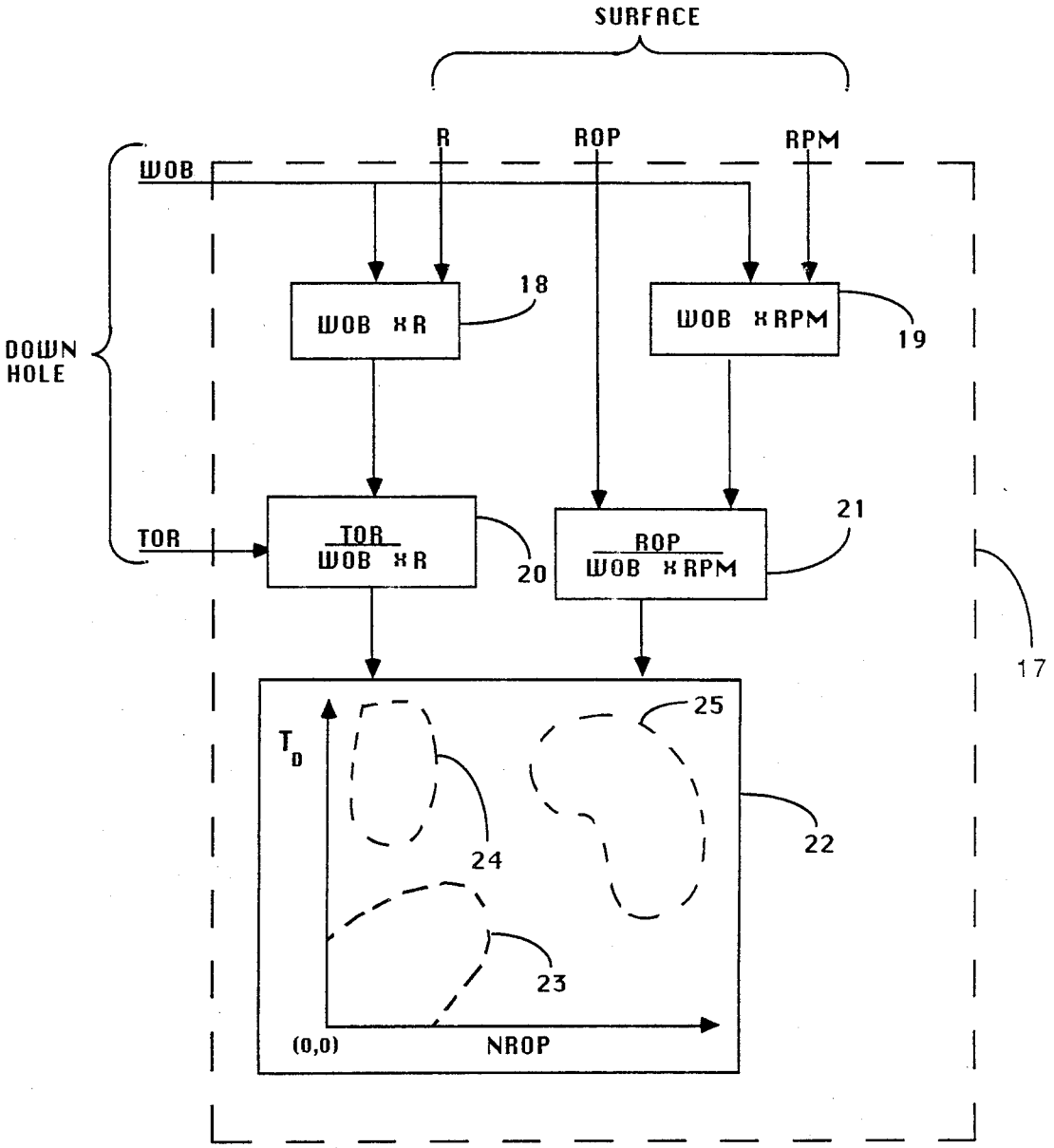
FIG. 2 is a block diagram of the interpretation functions performed on the drilling parameters generated from the apparatus of FIG. 1.

Reference is now made to FIG. 2 for a detailed representation of a preferred embodiment of the present invention FIG. 2 illustrates the processing functions performed within the surface processing means 17. The downhole weight on bit (WOB) and torque (TOR) signals derived from real time, in situ measurements made by MWD tool sensors 13 are delivered to the processor 17. Also provided to processor 17 are surface determined values of rotary speed (RPM), Bit Diameter (R), and Rate of Penetration (ROP). In a broad sense, processor 17 responds to the ROP and TOR inputs to detect the occurrence of one of two significant downhole events the penetration of the drill bit into a highly porous formation such as would be present in a highly fractured bed, and the development of an undergauge bit.

While it is possible for processor 17 to respond to ROP and TOR alone to produce desireable results, it has been found to be preferred to convert the ROP and TOR into the normalized quantities "Normalized ROP" (NROP) and "Dimensionless Torque" ($T_D$) respectively. This is done in processor 17 by forming the product of WOB and bit size (R) illustrated at block 18, forming the product of WOB and rotary speed (RPM) illustrated at block 19, and then dividing these values into TOR (block 20) and ROP (block 21) respectively to obtain $T_D$ and NROP.

Once $T_D$ and NROP have been obtained, these values are combined in any suitable manner, such as by means of look up tables in processor 17, to generate an indication of high porosity or of an undergauge bit. This step is graphically illustrated in FIG. 2 at block 22 which shows the NROP and $T_D$ data in the form of a crossplot. The crossplot of FIG. 2 illustrates three regions of significance into which the NROP and $T_D$ data points might fall. Region 23 is that region determined by observation of the normal drilling process in which normal values of NROP and $T_D$ fall. Clearly the boundaries of region 23 may vary from well to well or from zone to zone in the same well where different lithologies are encountered. Thus, although not anticipated in a single bit run, it may be desirable to redetermine the boundaries of "normal" region 23 each time a new lithology is encountered. Indeed it may also be desirable to redetermine the boundaries of region 23 as changes occur in the drilling process such as the wear of the drill bit 12 or the replacement of a worn bit with a new bit.

Data which falls outside of the "normal" region 23 indicate the occurrence of a possibly noteworthy drilling event. As previously discussed, at least two such events include the occurrence of the penetration of the drill bit 12 into a highly porous zone such as a fractured zone and the development of an undergauge bit. It has been discovered, much to the surprise of drilling experts, that zones of high porosity are characterized by both a relatively high value of NROP (relative to the normal values of region 23) and a relatively high value of $T_D$. Thus, a second region 25 in the crossplot of FIG. 2 is illustrated as that region which is indicative of high porosity or of a fractured zone. Formation zones of high porosity are of great significance inasmuch as hydrocarbons are frequently found to be accumulated in such zones in certain geological regions such as the geologically complex region of offshore Southern California.

Region 24 of the crossplot of FIG. 2 defines a third region of significant interest Here it has been discovered that relatively high values of $T_D$ accompanied by normal values of NROP correspond to the development of an undergauge or otherwise damaged bit Timely detection of such an event enables the early removal of the bit from the hole for confirmation and replacement if the undergauge tendency or damage is verified

What is claimed is:

1. A method for determining subsurface conditions encountered by a drill bit while drilling a borehole, comprising the steps of:

a. during the drilling process, determining rate of penetration and generating a signal indicative thereof;

b. during the drilling process, determining downhole torque and generating a signal indicative thereof;

c. in response to signals indicative of rate of penetration and downhole torque, generating an indication of the occurrence of a subsurface condition selected from the group comprising high formation porosity, a damaged bit bearing and the development of an undergauge bit.

2. The method for determining subsurface conditions encountered by a drill bit while drilling a borehole as recited in claim 1 wherein said signal indicative of downhole torque is a signal indicative of dimensionless torque determined by a process comprising the steps of:

a. during the drilling process, determining downhole weight on bit and generating a signal indicative thereof;

b. determining the diameter of the bit used for drilling the borehole;

c. combining said signal indicative of downhole weight on bit and said bit diameter to generate a first product signal; and d. combining said product signal and said downhole torque signal to generate a signal indicative of dimensionless torque.

3. The method for determining subsurface conditions encountered by a drill bit while drilling a borehole as recited in claim 1 wherein said signal indicative of rate of penetration is a signal indicative of normalized rate of penetration determined by a process comprising the steps of:

a. during the drilling process, determining downhole weight on bit and generating a signal indicative thereof;

b. during the drilling process, determining rotary speed of the bit and generating a signal indicative thereof;

c. combining said downhole weight on bit signal and said rotary speed signal to generate a second product signal; and d. combining said product signal and said rate of penetration signal to generate a signal indicative of normalized rate of penetration.

4. The method as recited in claim 3 wherein said combining step to generate a signal indicative of normalized rate of penetration includes the step of dividing said rate of penetration signal by said second product signal

5. The method as recited in claim 2 wherein said combining step to generate a signal indicative of dimensionless torque includes the step of dividing said downhole torque signal by said first product signal.

6. The method for determining subsurface conditions encountered by a drill bit while drilling a borehole as recited in claim 1 wherein said step of generating an indication of the occurrence of a subsurface condition includes the steps of;

a. determining from the drilling process normal values for downhole torque and rate of penetration; and b. generating an indication of high formation porosity when both of said downhole torque and rate of penetration signals are higher than their respective normal values.

7. The method for determining subsurface conditions encountered by a drill bit while drilling a borehole as recited in claim 1 wherein said step of generating an indication of the occurrence of a subsurface condition includes the steps of;

a. determining from the drilling process normal values for downhole torque and rate of penetration; and b. generating an indication of the development of an undergauge bit when said downhole torque signal is higher than normal and said rate of penetration signal is normal.

8. A method for determining subsurface conditions encountered by a drill bit while drilling a borehole, comprising the steps of:

a. during the drilling process, determining:

1. rate of penetration and generating a signal indicative thereof;
2. downhole torque and generating a signal indicative thereof;
3. downhole weight on bit and generating a signal indicative thereof;
4. rotary speed of the bit and generating a signal indicative thereof;

b. determining from the drilling process normal values for signals indicative of dimensionless torque and normalized rate of penetration;

c. determining the diameter of the bit used for drilling the borehole;

d. dividing the product of said downhole weight on bit and bit diameter into said downhole torque signal to generate a signal indicative of dimensionless torque;

e. dividing the product of said downhole weight on bit and said rotary speed into said rate of penetration signal to generate a signal indicative of normalized rate of penetration; and f. generating an indication of high porosity when both of said dimensionless torque and normalized rate of penetration signals are higher than said normal values; and g. generating an indication of the development of an undergauge or damaged bit when said dimensionless torque is higher than normal and said normalized rate of penetration is normal.

* * * * *